US011813623B2

(12) United States Patent
Romero

(10) Patent No.: US 11,813,623 B2
(45) **Date of Patent: *Nov. 14, 2023**

(54) SWIRL POT SHOWER HEAD ENGINE

(71) Applicant: ASSA ABLOY Americas Residential Inc., New Haven, CT (US)

(72) Inventor: Oscar Romero, Lake Forest, CA (US)

(73) Assignee: ASSA ABLOY Americas Residential Inc., New Haven, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/960,874

(22) Filed: Oct. 6, 2022

(65) Prior Publication Data

US 2023/0113943 A1 Apr. 13, 2023

Related U.S. Application Data

(63) Continuation of application No. 16/715,804, filed on Dec. 16, 2019, now Pat. No. 11,504,724, which is a (Continued)

(51) Int. Cl.

| | |
|---|---|
| ***B05B 1/18*** | (2006.01) |
| ***B05B 1/34*** | (2006.01) |
| *E03C 1/04* | (2006.01) |

(52) U.S. Cl.

CPC ..... *B05B 1/185* (2013.01); *B05B 1/18* (2013.01); *B05B 1/341* (2013.01); *B05B 1/3421* (2013.01); *E03C 1/0408* (2013.01)

(58) Field of Classification Search

CPC ..... B05B 1/185; B05B 1/18; B05B 1/341; B05B 1/3421; E03C 1/0408

See application file for complete search history.

(56) References Cited

U.S. PATENT DOCUMENTS

| | | | |
|---|---|---|---|
| 715,044 | A | 12/1902 | Fisher |
| 836,931 | A | 11/1906 | Koepnick |

(Continued)

FOREIGN PATENT DOCUMENTS

| | | | |
|---|---|---|---|
| CA | 2682588 | * | 4/2011 |
| CN | 203002500 | | 6/2013 |

(Continued)

OTHER PUBLICATIONS

Chinese Office Action and Search Report in Application 201780063267.7, dated Jul. 30, 2020, 8 pages.

(Continued)

*Primary Examiner* — Qingzhang Zhou
*Assistant Examiner* — Joel Zhou
(74) *Attorney, Agent, or Firm* — Merchant & Gould P.C.

(57) ABSTRACT

A showerhead engine internally swirls water within a swirling chamber. Multiple swirling chambers may be used, each separated from one another. The water is swirled angled through holes in a mid plate. As the water passes through the angled holes, it is projected out an angle. The water then contacts the swirling chamber wall and continues to follow the curvature of the wall. The curved wall paired with the angled entry causes the water to continue to swirl within the swirling chamber. The water is released out of the swirling chamber through slots, which allow the water to retain the angular velocity at a discharge angle.

20 Claims, 3 Drawing Sheets

Related U.S. Application Data continuation of application No. 15/703,566, filed on Sep. 13, 2017, now Pat. No. 10,549,290.

(60) Provisional application No. 62/393,735, filed on Sep. 13, 2016.

(56) References Cited

U.S. PATENT DOCUMENTS

| | | | |
|---|---|---|---|
| 969,657 | A | 9/1910 | Reade |
| 985,505 | A | 2/1911 | Brinkm |
| 1,007,793 | A | 11/1911 | Peabody |
| 1,150,940 | A | 8/1915 | Irish |
| 1,150,960 | A | 8/1915 | Peabody |
| 1,216,630 | A | 2/1917 | Tuthill |
| 1,509,671 | A | 9/1924 | Fish et al. |
| 1,534,546 | A | 4/1925 | Ross |
| 1,668,271 | A | 5/1928 | Fisk |
| 1,716,733 | A | 6/1929 | Nelson |
| 1,756,483 | A | 4/1930 | Estep |
| 1,862,812 | A | 6/1932 | Thompson |
| 1,880,880 | A | 10/1932 | Dietsch |
| 2,065,161 | A | 12/1936 | Thompson |
| 2,069,076 | A | 1/1937 | Majewski |
| RE20,488 | E | 2/1937 | Zinkil |
| 2,114,709 | A | 4/1938 | Hlinsky |
| 2,187,779 | A | 1/1940 | Gardner |
| 2,273,830 | A | 2/1942 | Brierly |
| 2,284,264 | A | 5/1942 | Crisp |
| 2,308,476 | A | 1/1943 | Gerrer |
| 2,544,417 | A | 3/1951 | Goddard |
| 2,593,884 | A | 4/1952 | Ifield |
| 2,736,607 | A | 2/1956 | Thompson |
| 2,746,801 | A | 5/1956 | Curran |
| 2,790,680 | A | 4/1957 | Rosholt |
| 2,805,099 | A | 9/1957 | Bailey |
| 2,904,263 | A | 9/1959 | Tate |
| 2,924,394 | A | 2/1960 | Clark |
| 3,019,990 | A | 2/1962 | Campbell |
| 3,067,950 | A | 12/1962 | Goldman |
| 3,120,348 | A | 2/1964 | O'Donnell |
| 3,182,916 | A | 5/1965 | Schulz |
| 3,330,070 | A | 7/1967 | Ferm |
| 3,404,844 | A | 10/1968 | Walsh |
| 3,713,587 | A * | 1/1973 | Carson ..... B05B 1/1645 239/383 |
| 3,792,582 | A | 2/1974 | Markowski |
| 4,040,396 | A | 8/1977 | Tomita |
| 4,247,049 | A | 1/1981 | Gailitis |
| 4,313,568 | A | 2/1982 | Shay |
| 4,471,912 | A | 9/1984 | Hancock |
| 4,570,860 | A | 2/1986 | Aprea |
| 5,906,317 | A | 5/1999 | Srinath |
| 5,971,301 | A | 10/1999 | Stouffer |
| 6,076,744 | A | 6/2000 | O'Brien |
| 6,076,745 | A | 6/2000 | Primdahl |
| 6,089,473 | A | 7/2000 | Keim |
| 6,186,409 | B1 | 2/2001 | Srinath |
| 6,240,945 | B1 | 6/2001 | Srinath |
| 6,253,782 | B1 | 7/2001 | Raghu |
| 6,283,387 | B1 | 9/2001 | Palestrant |
| 6,338,268 | B1 | 1/2002 | Stouffer |
| 6,415,994 | B1 | 7/2002 | Boggs |
| 6,457,658 | B2 | 10/2002 | Srinath |
| 6,497,375 | B1 | 12/2002 | Srinath |
| RE38,013 | E | 3/2003 | Stouffer |
| 6,572,570 | B1 | 6/2003 | Bums |
| 6,575,386 | B1 | 6/2003 | Thurber, Jr. |
| 6,581,856 | B1 | 6/2003 | Srinath |
| 6,595,350 | B1 | 7/2003 | Stouffer |
| 6,695,229 | B1 | 2/2004 | Heinbuch |
| 6,705,538 | B2 | 3/2004 | Fecht |
| 6,729,564 | B2 | 5/2004 | Srinath |
| 6,755,797 | B1 | 6/2004 | Stouffer |
| 6,767,331 | B2 | 7/2004 | Stouffer |
| 6,796,516 | B2 | 9/2004 | Maier |
| 6,805,164 | B2 | 10/2004 | Stouffer |
| 6,854,670 | B2 | 2/2005 | Sumisha |
| 6,904,626 | B1 | 6/2005 | Hester |
| 6,916,300 | B2 | 7/2005 | Hester |
| 6,938,835 | B1 | 9/2005 | Stouffer |
| 6,948,244 | B1 | 9/2005 | Crockett |
| 6,948,513 | B2 | 9/2005 | Steerman |
| 6,974,095 | B2 | 12/2005 | Harata |
| 6,978,951 | B1 | 12/2005 | Raghu |
| 7,014,131 | B2 | 3/2006 | Berning |
| 7,036,749 | B1 | 5/2006 | Steerman |
| 7,037,280 | B1 | 5/2006 | Burns |
| 7,070,129 | B1 | 7/2006 | Raghu |
| 7,111,795 | B2 | 9/2006 | Thong |
| 7,111,800 | B2 | 9/2006 | Berning |
| 7,134,609 | B1 | 11/2006 | Stouffer |
| 7,152,808 | B2 | 12/2006 | Jenkins |
| 7,185,831 | B2 | 3/2007 | Goenka |
| 7,243,861 | B2 | 7/2007 | Foubert |
| 7,267,290 | B2 | 9/2007 | Gopalan |
| 7,293,722 | B1 | 11/2007 | Srinath |
| 7,354,008 | B2 | 4/2008 | Hester |
| 7,357,565 | B2 | 4/2008 | Gopalan |
| 7,472,848 | B2 | 1/2009 | Gopalan |
| 7,478,764 | B2 | 1/2009 | Gopalan |
| 7,478,769 | B1 | 1/2009 | Pautsch |
| 7,611,080 | B2 | 11/2009 | Peterson |
| 7,651,036 | B2 | 1/2010 | Gopalan |
| 7,677,480 | B2 | 3/2010 | Russell |
| 7,766,261 | B1 | 8/2010 | Santamarina |
| 7,775,456 | B2 | 8/2010 | Gopalan |
| 7,784,716 | B2 | 8/2010 | Fukutomi |
| 7,921,844 | B1 | 4/2011 | Santamarina |
| 7,950,077 | B2 | 5/2011 | Santamarina |
| 8,172,162 | B2 | 5/2012 | Gopalan |
| 8,205,812 | B2 | 6/2012 | Hester |
| 8,313,046 | B2 | 11/2012 | Short |
| 8,348,606 | B2 | 1/2013 | Gopalan |
| 8,387,171 | B2 | 3/2013 | Farber |
| 8,579,214 | B2 | 11/2013 | Headland |
| 8,640,675 | B2 | 2/2014 | Ricco |
| 8,662,421 | B2 | 3/2014 | Russell |
| 8,684,686 | B2 | 4/2014 | Gopalan |
| 8,702,020 | B2 | 4/2014 | Gopalan |
| 8,770,229 | B2 | 7/2014 | Gopalan |
| 9,016,601 | B2 | 4/2015 | Headland |
| 9,016,602 | B2 | 4/2015 | Grether |
| 9,067,221 | B2 | 6/2015 | Gopalan |
| 9,089,856 | B2 | 7/2015 | Gopalan |
| 9,404,243 | B2 | 8/2016 | Cacka et al. |
| 10,549,290 | B2 | 2/2020 | Romero |
| 11,504,724 | B2 | 11/2022 | Romero |
| 2003/0052197 | A1 | 3/2003 | Bui |
| 2003/0146301 | A1 | 8/2003 | Sun |
| 2005/0242214 | A1 | 11/2005 | Joseph |
| 2006/0097081 | A1 | 5/2006 | Goenka |
| 2007/0290073 | A1 | 12/2007 | Peterson |
| 2012/0227770 | A1 | 9/2012 | Kaneko |
| 2013/0193234 | A1 | 8/2013 | Zhou |
| 2014/0239081 | A1 | 8/2014 | Schlecht |
| 2016/0039596 | A1 | 2/2016 | Nelson |
| 2016/0238255 | A1 | 8/2016 | Ryon |
| 2016/0325293 | A1 | 11/2016 | Irwin |
| 2016/0325714 | A1 | 11/2016 | Yuda |

FOREIGN PATENT DOCUMENTS

| | | |
|---|---|---|
| CN | 103282666 | 9/2013 |
| CN | 103801467 | 5/2014 |

OTHER PUBLICATIONS

Chinese Supplementary Search Report in Application 201780063267.7, dated May 10, 2021, 1 page.

PCT International Preliminary Report on Patentability in International Application PCT/US2017/051378, dated Mar. 28, 2019, 8 pages.

(56) References Cited

OTHER PUBLICATIONS

PCT International Search Report and Written Opinion in International Application PCT/US2017/051378, dated Dec. 15, 2017, 8 pages.
U.S. Pat. No. 715,044 issued Dec. 2, 1902 to J. Fisher.
U.S. Pat. No. 836,931 issued Nov. 27, 1906 to C.A. Koepnick.
U.S. Pat. No. 969,657 issued Sep. 6, 1910 to J. Reade.
U.S. Pat. No. 985,505 issued Feb. 28, 1911 to L.A. Brinkm.

* cited by examiner

SWIRL POT SHOWER HEAD ENGINE

CROSS REFERENCE TO EARLIER APPLICATIONS

This application is a continuation of U.S. patent application Ser. No. 16/715,804, now U.S. Pat. No. 11,504,724, filed Dec. 16, 2019, which is a continuation of U.S. patent application Ser. No. 15/703,566, now U.S. Pat. No. 10,549,290, filed Sep. 13, 2017, which claims priority to U.S. Provisional Application Serial No. 62/393,735, filed on Sep. 13, 2016, the entire contents of which are hereby expressly incorporated herein by reference.

TECHNICAL FIELD

The invention relates to showerhead engine devices. More particularly, the invention relates to generating flow patterns and movement of water exiting the shower engine without the use of nozzle jets or moving parts.

BACKGROUND OF THE INVENTION

Showerheads are traditionally used to deliver water from a potable water source such as a municipal supply or a well into a bathroom shower. Many different kinds of showerheads exist to meet a wide range of needs. Some showerheads deliver a high pressure stream which is achieved by restricting the flow rate, thus increasing the pressure. Other showerheads increase the volume of water delivered, which in turn lowers the pressure of the delivered stream.

A common hurdle for any showerhead design is that state and federal laws in the United States limit the amount of water a showerhead can deliver. In order to be universally sold, a showerhead typically has to deliver no more than 2.5 gallons of water per minute. Additional limitations on water flow are also expected in the near future. As the supply of potable water pressure is typically fixed and not variable, showerhead designs are limited to the types of patterns and user experiences available to meet these strict requirements.

One known solution has been to provide the showerhead with an "engine" that manipulates the water delivery. Typical engines include turbines or nozzles that deliver a unique water delivery pattern not commonly available with a traditional showerhead. An example of a unique delivery device includes turbines within the showerhead that produce swirling patterns as the water exits the showerhead.

A known issue with these types of showerheads is that as the number of parts added to a showerhead increases, the associated costs increase as well. Additionally, moving parts such as turbines introduce potential sources of failures and a level of fragility to the showerhead. Lastly, common impurities in potable water such as minerals can lead to scaling, which over time can clog the turbine or otherwise affect the performance.

What is therefore needed is a showerhead engine that produces a unique shower experience while conforming to the traditional water flow rate delivery requirements.

What is also needed is a showerhead engine that produces movement of the water without the use of moving parts. What is also needed is a showerhead engine that produces a unique water flow experience in a cost effective manner.

SUMMARY AND OBJECT OF THE INVENTION

A shower head engine includes a back plate with an opening in fluid communication with a supply of water. A mid plate spaced apart from the back plate forms a collection chamber between the back plate and the mid plate. A first set of orifices in the mid plate at a first diameter along with a second set of orifices in the mid plate at a second diameter greater than the first diameter allow water to pass through the mid plate and into a first and second swirl chamber.

The first and second swirl chambers are formed by a front plate spaced apart from the mid plate. A separation wall extending from the mid plate separates the first swirl chamber from the second swirl chamber. A first set of holes in the front plate that are in fluid communication with the first swirl chamber and a second set of holes in the front plate in fluid communication with the second swirl chamber spray the water from the respective first and second swirl chambers.

The first set of orifices in the mid plate are formed at an angle other than normal to a front side of the mid plate such that, as water passes through the first set of orifices, it exits the front side and enters the first swirl chamber with an angular velocity, thus generating a swirling motion of the water within the first swirl chamber.

Similarly, the second set of orifices in the mid plate are formed at an angle other than normal to a front side of the mid plate such that, as water passes through the second set of orifices, it exits the front side and enters the second swirl chamber with an angular velocity, thus generating a swirling motion of the water within the second swirl chamber.

The angular velocity of the water in the first swirl chamber is in a first rotational direction (e.g., clockwise) and the angular velocity of the water in the second swirl chamber is in a second rotational direction opposite the first rotational direction (e.g., counterclockwise) such that, when the water exits the respective holes in the front plate, it exits at opposing angles producing a grid-like affect. The first and second sets of holes in the front plate are elongated slots that are normal to the face surface, which allows the angular velocity of the water within the respective swirl chambers to force the water out of the elongated slots while retaining the angular momentum and produces angled streams of water.

BRIEF DESCRIPTION OF THE DRAWINGS

The present disclosure will be described hereafter with reference to the attached drawings which are given as non-limiting examples only, in which.

Corresponding reference characters indicate corresponding parts throughout the several views. The exemplifications set out herein illustrate an embodiment of the invention, and such exemplifications are not to be construed as limiting the scope of the invention in any manner.

DETAILED DESCRIPTION

Figure 1:
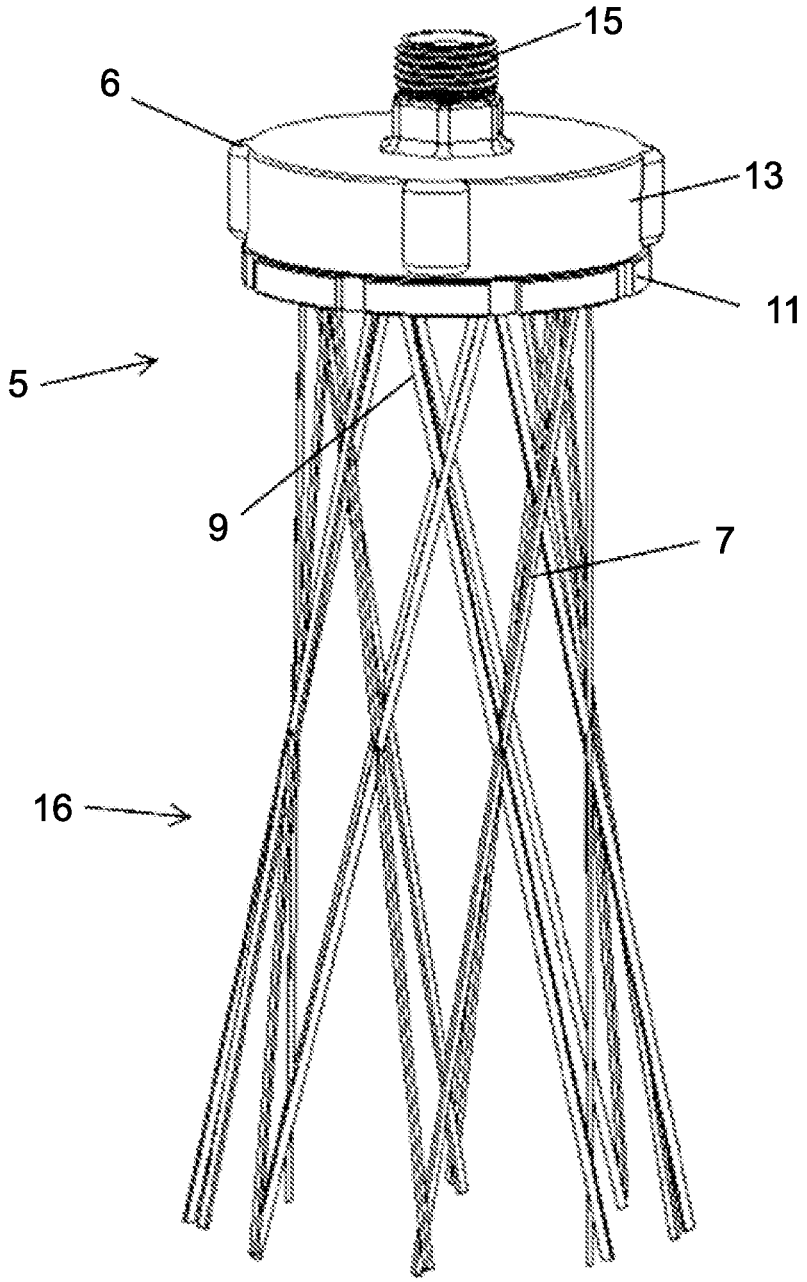
FIG. 1 is a side perspective view of a showerhead engine in use and spraying water in a lattice pattern according to an embodiment of the invention.

FIG. 1 shows a perspective view of the showerhead engine 5 according to an embodiment of the invention. The showerhead engine 5 may be implemented into a variety of showerheads. In this example, the showerhead engine 5 itself forms the showerhead 6. It is envisioned that the showerhead engine 5 may be fitted within any other showerhead to give it a different appearance.

The showerhead engine 5 produces a spray pattern 16 that is formed by a plurality of sets of water streams. In the embodiment shown, a first set of streams 7 exits the front plate 11 of the showerhead engine 5 at one angle, while a second set of streams 9 exits the front plate 11 at a different angle. The exact degree of each respective angle may be changed without departing from the nature of the invention. Preferably, the showerhead engine produces multiple streams of water at unique angles to produce a lattice or grid-like appearance.

The angled water streams are not produced by conventional nozzles which are typically angled. Instead, the showerhead engine 5 generates a swirling motion for the water between a back plate 13 and the front plate 11. The water may be introduced to the showerhead engine 5 through a threaded collar 15 as shown, but any other known fastening mechanism may be used to provide water to the showerhead engine 5.

Figure 2:
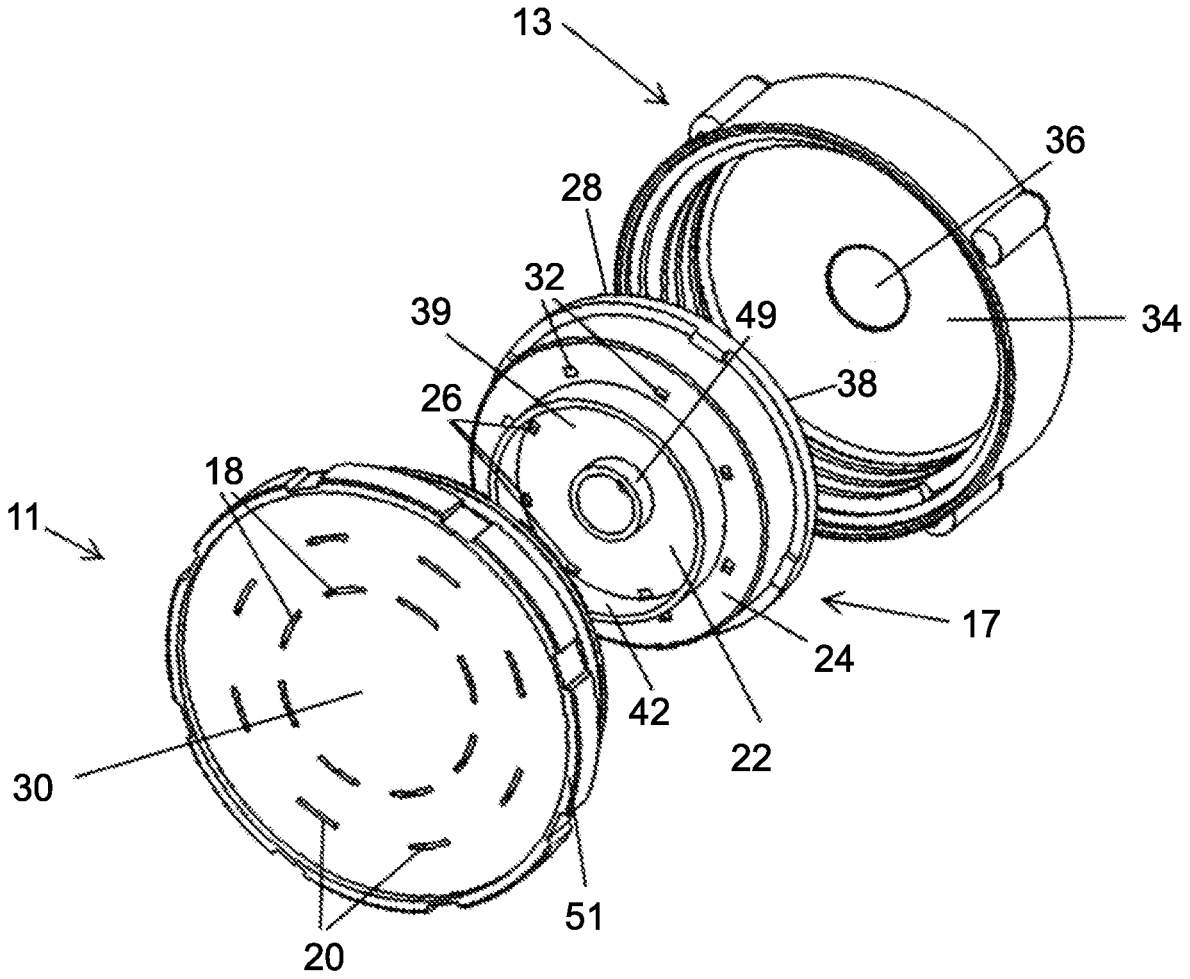
FIG. 2 is an exploded view of the showerhead engine of FIG. 1.

Looking now at FIG. 2, the showerhead engine 5 is in exploded form showing the inner workings within the back plate 13 and the front plate 11. As water enters an opening 36 in the back plate 13, it is collected within a collection chamber 34. A mid plate 17 seals against the back plate 13 by a support flange 28, thus preventing the water from bypassing the mid plate 17. As water collects in the collection chamber, it generates pressure which causes it to flow out of orifices in the mid plate 17. A first set of orifices 26 form a smaller diameter ring than a second set of orifices 32 which are axially spaced out from the center of the mid plate 17. A separation wall 42 extends from a front side 39 of the mid plate 17 separating the first set of orifices 26 from the second set of orifices 32.

The separation wall 42 allows the water that passes through the first set of orifices 26 to be kept separate from the water that passes through the second set of orifices 32. The support flange 28 abuts the front plate 11 to maintain the separation of the respective water from the first set of orifices 26 and the second set of orifices 32, thereby forming a first swirl chamber 22 and a second swirl chamber 24.

Water that enters the first swirl chamber 22 from the first set of orifices 26, and water that enters the second swirl chamber 24 from the second set of orifices 32, may be compelled to store kinetic energy. The first swirl chamber 22 may store the water and preserve its kinetic energy separately from water in the second swirl chamber 24, and vice versa. The kinetic energy may be generated in the form of water momentum by separately swirling the water around the first swirl chamber 22 and the second swirl chamber 24. In order to swirl the water, the first set of orifices 26 and the second set of orifices 32 may be formed through the thickness of the mid plate 17 at an angle other than normal to a surface of the mid plate 17.

Figure 3:
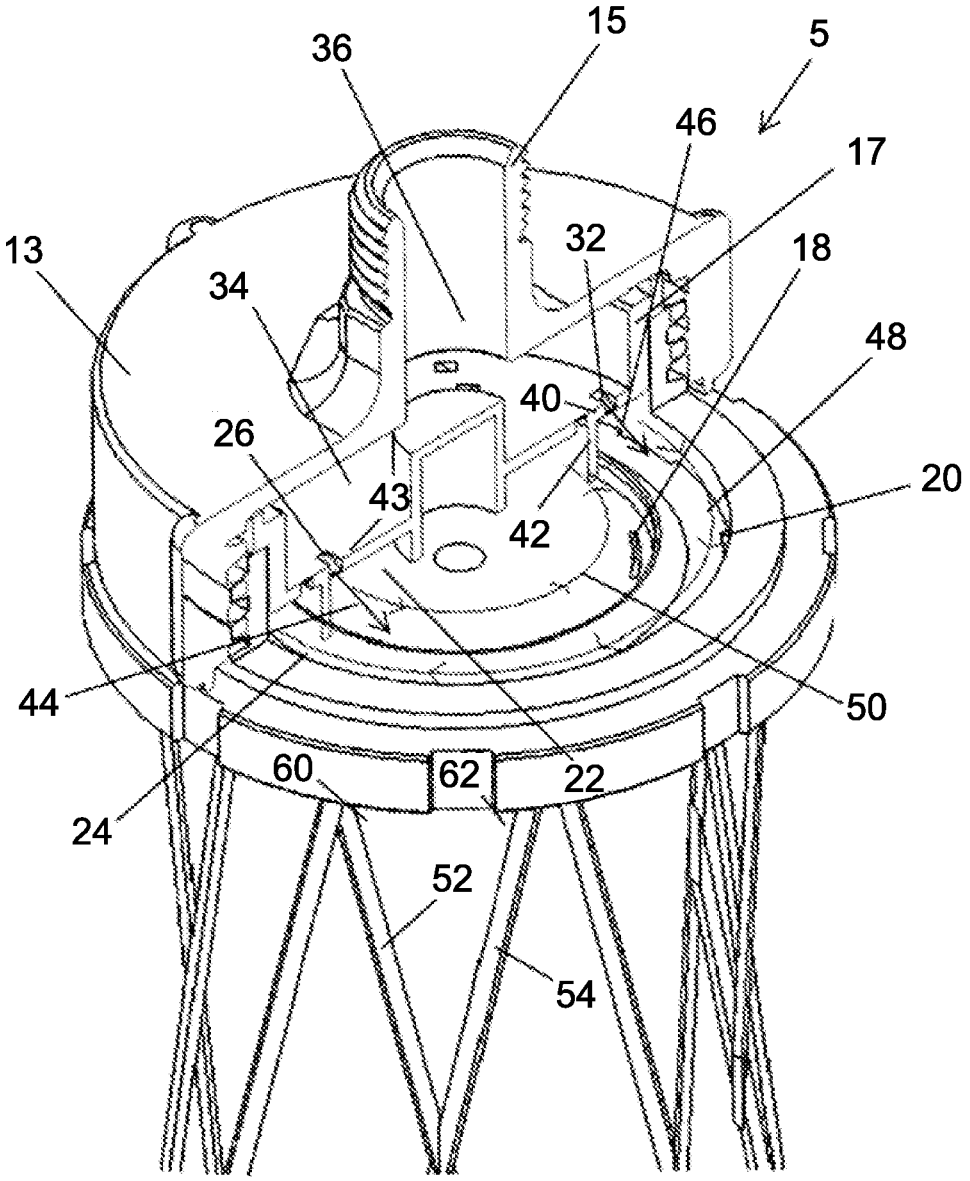
FIG. 3 is a cross sectional view of the showerhead engine of FIG. 1.

For example, looking to FIG. 3, a representation of the showerhead engine 5 is shown. The back plate 13 allows water to collect in the collection chamber 34 prior to passing through the mid plate 17. As shown in the representation, the first set of orifices 26 are formed at an angle 43 with respect to the surface of the mid plate 17. Similarly, the second set of orifices 32 are formed through the mid plate 17 at an angle 40 which is different than angle 43. The angle 43 of the first set of orifices 26 thereby produces a water jet 44 that is angled. The angle 40 of the second set of orifices 32 also produces a water jet 46 that is also angled, but note the direction of each respective water jet. The different angles produce water jets in different directions.

The first swirl chamber 22, best shown in FIG. 2, causes water to swirl within the separation wall 42 and a center wall 49. Each of the respective walls 42, 49 includes a curvature, which compels the water jet 44 to run alongside of the walls 42, 49. The result is a swirling motion 48 (in this case, generally circular) which is influenced by and follows a rotational direction consistent with the angled direction of the water jet 44.

Similarly, the second swirl chamber 24, best shown in FIG. 2, causes water to swirl within the separation wall 42 and the front plate wall 51. Each respective wall 42, 51 also includes a curvature, which compels the water jet 46 to run alongside of the walls 42, 51. The result is a swirling motion 50 (in this case, also generally circular) which is influenced by and follows a rotational direction consistent with the angled direction of the water jet 46.

During operation, the water within the first swirl chamber 22 and the second swirl chamber 24 continues to swirl, building up momentum and an angular velocity. The respective angular velocities are shown in the form of the swirling motions 48, 50. As the pressure builds, the water exits through a first set of holes 18 and a second set of holes 20. The first set of holes 18 expels water within the first swirling chamber 22 in the form of a water jet 52 at an angle 60. The second set of holes 20 expels water within the second swirling chamber 24 in the form of a water jet 54 at a different angle 62. The angles of water jets 52 and 54 are generated as a result of the swirling motion within the respective swirl chambers and not, for example, by an angled shape of the first and second sets of holes 18, 20.

Preferably, the first set of holes 18 and the second set of holes 20 are in the form of elongated slots as shown in FIG. 2. The slots are preferably extended along the arc of the swirling motion, which allows the exiting water to maintain angular velocity as it passes through a face surface 30 of the front plate 11.

Although the present disclosure has been described with reference to particular means, materials and embodiments, from the foregoing description, one skilled in the art can easily ascertain the essential characteristics of the present disclosure and various changes and modifications may be made to adapt the various uses and characteristics without departing from the spirit and scope of the present invention as set forth in the following claims.

I claim:

1. A showerhead comprising:

a showerhead engine having an inlet end configured to receive a flow of water and an outlet end including a plurality of holes configured to produce a spray pattern of water, the spray pattern of water having at least a first set of streams and a second set of streams, the first set of streams being at a different angle than the second set of streams;

a first swirl chamber defined within the showerhead engine and adapted to receive a first portion of the flow of water and induce a first swirling movement having a first angular velocity into the first portion of the flow of water; and a second swirl chamber defined within the showerhead engine and adapted to receive a second portion of the flow of water and induce a second swirling movement having a second angular velocity into the second portion of the flow of water, the second swirl chamber discrete from the first swirl chamber, wherein the first portion of the flow of water exits through a first set of the plurality of holes forming the first set of streams concurrently as the second portion of the flow of water exits through a second set of the plurality of holes forming the second set of streams, and wherein the plurality of holes are shaped and sized to allow the first and second angular velocities to be maintained and form the first and second sets of streams.

2. The showerhead of claim 1, wherein the plurality of holes are not angled relative to the outlet end.

3. The showerhead of claim 1, wherein the plurality of holes are normal relative to the outlet end.

4. The showerhead of claim 1, wherein the plurality of holes are elongated and have an arc shape.

5. The showerhead of claim 1, wherein the second swirl chamber is concentric with the first swirl chamber.

6. The showerhead of claim 1, wherein the first swirling movement within the first swirl chamber is in an opposite direction than the second swirling movement within the second swirl chamber.

7. The showerhead of claim 1, wherein the first swirl chamber includes a first set of inlet orifices and the second swirl chamber includes a second set of inlet orifices, the first and second sets of inlet orifices are formed at an angle other than normal to the inlet end to induce the first and second swirling movements.

8. The showerhead of claim 7, wherein a first plate defines the first and second sets of inlet orifices and a second plate defines the plurality of holes, the first plate parallel with the second plate.

9. The showerhead of claim 1, wherein the spray pattern of water is a lattice or grid-like in appearance.

10. The showerhead of claim 1, further comprising a collection chamber disposed upstream of the first and second swirl chambers and in flow communication with both the first and second swirl chambers.

11. A showerhead comprising:

a showerhead engine having an inlet end configured to receive a flow of water and an outlet end including a plurality of holes configured to produce a spray pattern of water;

a first flow path defined within the showerhead engine and having a first set of inlet orifices, a first swirl chamber, and a first set of the plurality of holes, the first flow path configured to induce a first swirling movement within the first swirl chamber having a first angular velocity into a first portion of the flow of water to generate a first set of streams of the spray pattern of water; and a second flow path defined within the showerhead engine and having a second set of inlet orifices, a second swirl chamber, and a second set of the plurality of holes, the second flow path configured to induce a second swirling movement within the second swirl chamber having a second angular velocity into a second portion of the flow of water to generate a second set of streams of the spray pattern of water, the first swirling movement being at a different rotational direction than the second swirling movement, wherein the first flow path is discrete from the second flow path and the first set of streams is generated concurrently with the second set of streams, and wherein the plurality of holes are elongated allowing the first and second sets of streams to maintain the first and second angular velocities generated within the first and second swirl chambers.

12. The showerhead of claim 11, wherein the showerhead engine includes a first plate, a second plate, and a separation wall, the first plate defining the first and second sets of inlet orifices, the second plate defining the plurality of holes, and the separating wall separating the first swirl chamber from the second swirl chamber.

13. The showerhead of claim 12, wherein the first plate, the second plate, and the separation wall are fixed relative to each other.

14. The showerhead of claim 12, wherein the plurality of holes are normal to an end surface of the second plate.

15. The showerhead of claim 12, wherein the first and second sets of inlet orifices are angled relative to an end surface of the first plate.

16. The showerhead of claim 12, wherein the showerhead engine further includes a center wall concentric with the separation wall and at least partially defining the first swirl chamber.

17. The showerhead of claim 11, wherein the first set of streams have a different angle than the second set of streams.

18. The showerhead of claim 11, wherein the spray pattern of water is a lattice or grid-like in appearance.

19. The showerhead of claim 11, wherein the first set of inlet orifices are radially spaced from the second set of inlet orifices.

20. The showerhead of claim 11, wherein the first set of the plurality of holes are radially spaced from the second set of the plurality of holes.

* * * * *